US006605128B2

(12) United States Patent
Larson et al.

(10) Patent No.: US 6,605,128 B2
(45) **Date of Patent: *Aug. 12, 2003**

(54) ABRASIVE ARTICLE HAVING PROJECTIONS ATTACHED TO A MAJOR SURFACE THEREOF

(75) Inventors: Eric G. Larson, Lake Elmo, MN (US); Don H. Kincaid, Hudson, WI (US); Ernest L. Thurber, Woodbury, MN (US); Ronald D. Provow, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/813,368

(22) Filed: Mar. 20, 2001

(65) Prior Publication Data

US 2002/0170236 A1 Nov. 21, 2002

(51) Int. Cl.[7] ..... B24D 3/00; B24D 11/00; B24D 3/28

(52) U.S. Cl. ..... 51/298; 51/295; 51/307; 51/308; 51/309; 51/293; 51/297

(58) Field of Search ..... 51/298, 295, 307, 51/308, 309, 293, 297

(56) References Cited

U.S. PATENT DOCUMENTS

| | | | |
|---|---|---|---|
| 1,910,444 | A | 5/1933 | Nicholson |
| 2,951,825 | A | 9/1960 | Reinking et al. |
| 2,958,593 | A | 11/1960 | Hoover et al. |
| 3,018,262 | A | 1/1962 | Schroeder |
| 3,041,156 | A | 6/1962 | Rowse et al. |
| 3,151,027 | A | 9/1964 | Cooley et al. |
| 3,226,214 | A | 12/1965 | Daniels et al. |
| 3,298,998 | A | 1/1967 | McConnell et al. |
| 3,466,814 | A | 9/1969 | Singer et al. |
| 3,615,303 | A | 10/1971 | Singer et al. |
| 3,651,012 | A | 3/1972 | Holub et al. |
| 3,689,346 | A | 9/1972 | Rowland |
| 3,848,640 | A | 11/1974 | Crawford et al. |
| 4,026,705 | A | 5/1977 | Crivello et al. |
| 4,032,673 | A | 6/1977 | Schroeter et al. |
| 4,047,903 | A | 9/1977 | Hesse et al. |
| 4,069,054 | A | 1/1978 | Smith |
| 4,107,116 | A | 8/1978 | Riew et al. |
| 4,136,102 | A | 1/1979 | Crivello |
| 4,173,476 | A | 11/1979 | Smith et al. |
| 4,227,350 | A | 10/1980 | Fitzer |
| 4,311,489 | A | 1/1982 | Kressner |
| 4,314,827 | A | 2/1982 | Leitheiser et al. |
| 4,318,766 | A | 3/1982 | Smith |
| 4,393,021 | A | 7/1983 | Eisenberg et al. |
| 4,396,657 | A | 8/1983 | Ibrahim |
| 4,457,766 | A | 7/1984 | Caul |
| 4,547,204 | A | 10/1985 | Caul |
| 4,575,384 | A | 3/1986 | Licht et al. |
| 4,588,419 | A | 5/1986 | Caul et al. |
| 4,588,420 | A | 5/1986 | Charvat |
| 4,601,769 | A | 7/1986 | DeHoff |
| 4,623,364 | A | 11/1986 | Cottringer et al. |
| 4,652,275 | A | 3/1987 | Bloecher et al. |
| 4,684,678 | A | 8/1987 | Schultz et al. |
| 4,707,534 | A | 11/1987 | Schultz |
| 4,735,632 | A | 4/1988 | Oxman et al. |
| 4,744,802 | A | 5/1988 | Schwabel |
| 4,751,138 | A | 6/1988 | Tumey et al. |
| 4,770,671 | A | 9/1988 | Monroe et al. |
| 4,773,599 | A | 9/1988 | Lynch et al. |
| 4,799,939 | A | 1/1989 | Bloecher et al. |
| 4,802,896 | A | 2/1989 | Law et al. |
| 4,822,464 | A | 4/1989 | Pocius |
| 4,836,832 | A | 6/1989 | Tumey et al. |
| 4,871,376 | A | 10/1989 | DeWald |
| 4,881,951 | A | 11/1989 | Wood et al. |
| 4,927,431 | A | 5/1990 | Buchanan et al. |
| 4,952,342 | A | 8/1990 | Drain et al. |
| 4,964,883 | A | 10/1990 | Morris et al. |
| 4,983,672 | A | 1/1991 | Almer et al. |
| 4,985,340 | A | 1/1991 | Palazzotto et al. |
| 4,997,461 | A | 3/1991 | Markhoff-Matheny et al. |
| 5,009,675 | A | 4/1991 | Kunz et al. |
| 5,011,508 | A | 4/1991 | Wald et al. |

(List continued on next page.)

FOREIGN PATENT DOCUMENTS

| | | |
|---|---|---|
| EP | 109851 A2 | 5/1984 |
| EP | 306161 A2 | 3/1989 |
| EP | 306162 A2 | 3/1989 |
| GB | 964806 | 7/1964 |
| GB | 994484 | 6/1965 |
| JP | 63-351 | 1/1988 |
| WO | WO 98/10896 | 3/1998 |

OTHER PUBLICATIONS

ASTM E399–90, "Standard Test Method for Plane–Strain Fracture Toughness of Metallic Materials," *Annual Book of ASTM Standards* pp. 431–461 (1997), (no month).

*Encyclopedia of Polymer Science and Technology*, vol. 8, John Wiley & Sons, Inc., pp. 651–666 (1968), (no month).

Sherman et al., "Epoxy Resins," *Concise Encyclopedia of Chemical Technology*, vol. 24, 3rd Ed., Kirk–Othmer, Eds., John–Wiley & Sons, New York, Title Page, Publication Page, and pp. 431–433 (1985), (no month).

*Primary Examiner*—Michael Marcheschi
(74) *Attorney, Agent, or Firm*—Bradford B. Wright; Gregory D. Allen

(57) ABSTRACT

The present invention provides abrasive articles having projections attached to a major surface thereof, and methods of making such articles. The articles include (1) a reaction product of components that include (a) an epoxy-functional material, (b) at least one of a cyclic anhydride or a diacid derived therefrom; and/or (2) a polymeric material preparable by combining at least (a) an epoxy-functional material, and (b) at least one of a cyclic anhydride or a diacid derived therefrom.

35 Claims, 2 Drawing Sheets

U.S. PATENT DOCUMENTS 5,042,991 A 8/1991 Kunz et al.
5,045,363 A 9/1991 Almer et al.
5,061,294 A 10/1991 Harmer et al.
5,090,968 A 2/1992 Pellow
5,137,542 A 8/1992 Buchanan et al.
5,152,917 A 10/1992 Pieper et al.
5,201,916 A 4/1993 Berg et al.
5,203,884 A 4/1993 Buchanan et al.
5,213,591 A 5/1993 Celikkaya et al.
5,215,863 A 6/1993 Nawata et al.
5,314,513 A 5/1994 Miller et al.
5,314,959 A 5/1994 Rolando et al.
5,360,462 A 11/1994 Harmer et al.
5,435,816 A 7/1995 Spurgeon et al.
5,436,063 A 7/1995 Follett et al.
5,451,446 A 9/1995 Kincaid et al.
5,496,387 A 3/1996 Culler
5,498,235 A 3/1996 Flower
5,500,273 A 3/1996 Holmes et al.
5,549,962 A 8/1996 Holmes et al.
5,571,297 A 11/1996 Swei et al.
5,580,647 A 12/1996 Larson et al.
5,667,842 A 9/1997 Larson et al.
5,681,217 A 10/1997 Hoopman et al.
5,704,952 A 1/1998 Law et al.
5,714,259 A 2/1998 Holmes et al.
5,833,724 A 11/1998 Wei et al.
5,855,632 A 1/1999 Stoetzel et al.
5,855,652 A 1/1999 Talley
5,863,306 A 1/1999 Wei et al.
5,863,847 A 1/1999 De Voe et al.
5,914,299 A * 6/1999 Harmer et al. ..... 51/295
5,922,784 A 7/1999 DeVoe et al.
5,946,991 A 9/1999 Hoopman
5,975,987 A 11/1999 Hoopman et al.
6,017,831 A 1/2000 Beardsley et al.
6,076,248 A 6/2000 Hoopman et al.
6,077,601 A 6/2000 DeVoe et al.
6,129,540 A 10/2000 Hoopman et al.
6,139,594 A 10/2000 Kincaid et al.

* cited by examiner

ABRASIVE ARTICLE HAVING PROJECTIONS ATTACHED TO A MAJOR SURFACE THEREOF

FIELD OF THE INVENTION

This invention relates to abrasive articles having projections attached to a major surface thereof, and methods for making such articles. The articles include (1) a reaction product of components that include (a) an epoxy-functional material, (b) at least one of a cyclic anhydride or a diacid derived therefrom; and/or (2) a polymeric material preparable by combining at least (a) an epoxy-functional material, and (b) at least one of a cyclic anhydride or a diacid derived therefrom.

BACKGROUND

Conventional coated abrasive articles include a backing having a plurality of abrasive particles bonded to at least one major surface thereof by one or more binders (e.g., make, size, and supersize coats). Abrasive articles (e.g., structured abrasive articles) are preferably formed from a slurry, and include a backing bearing on at least one major surface thereof an abrasive layer including a plurality of abrasive particles dispersed in a binder. For a structured abrasive article, the abrasive layer is in the form of a plurality of shaped abrasive composites bonded to a backing. Useful backings include, for example, paper, polymeric film, vulcanized fiber, nonwoven substrates, and cloth. Cloth backings are generally either stitchbonded or woven. These backings are often treated with treatment coat(s) to seal the cloth and to protect the individual fibers. Structured abrasive articles are disclosed, for example, in U.S. Pat. No. 5,152,917 (Pieper et al.); U.S. Pat. No. 5,681,217 (Hoopman et al.); and U.S. Pat. No. 5,855,652 (Stoetzel et al.).

Certain known structured abrasive articles are capable of working well in a number of finishing and grinding operations. However, there is always potential for improved performance. Areas where improved performance would be particularly useful is in wet grinding and finishing operations and in coarser grade products where higher stock removal rates and longer abrasive lives would be beneficial.

SUMMARY OF THE INVENTION

In one aspect, the present invention provides an abrasive article including a backing having a major surface; a plurality of projections attached to the major surface; and a binder including a reaction product of components including (a) an epoxy-functional material, and (b) at least one of a cyclic anhydride or a diacid derived therefrom. Preferably, the components further include (c) a polyfunctional (meth) acrylate. Optionally, the binder further includes a plurality of abrasive grits. Preferably, the projections are composite projections including abrasive grits. Preferably the binder is present in the backing, on the backing, or in the projections.

In another aspect, the present invention provides an abrasive article including a backing having a major surface; a plurality of projections attached to the major surface; and a binder preparable by combining at least (a) an epoxy-functional material, and (b) at least one of a cyclic anhydride or a diacid derived therefrom. Preferably, the binder is preparable by combining at least (a) an epoxy-functional material, (b) at least one of a cyclic anhydride or a diacid derived therefrom, and (c) a polyfunctional (meth)acrylate. Optionally, the binder further includes a plurality of abrasive grits. Preferably, the projections are composite projections including abrasive grits. Preferably, the binder is present in the backing, on the backing, or in the projections.

In another aspect, the present invention provides a method of making an abrasive article including providing a production tool having a three-dimensional body with one or more cavities, at least a portion of the one or more cavities having therein a composition preparable by combining at least (a) an epoxy-functional material, and (b) at least one of a cyclic anhydride or a diacid derived therefrom, and the production tool having a backing that has a major surface adjacent the one or more cavities; and at least partially curing at least a portion of the composition to form an abrasive article. Preferably, the composition is preparable by combining at least (a) an epoxy-functional material, (b) at least one of a cyclic anhydride or a diacid derived therefrom, and (c) a polyfunctional (meth)acrylate. Optionally, providing the production tool further includes providing an intermediate layer between the major surface of the backing and at least a portion of the one or more cavities. Preferably, the method includes irradiating at least a portion of the composition. Preferably, the method includes thermally curing at least a portion of the abrasive article.

In one embodiment, the method of making an abrasive article includes providing a production tool having a three-dimensional body with one or more cavities, at least a portion of the one or more cavities having therein a composition preparable by combining at least (a) an epoxy-functional material, and (b) at least one of a cyclic anhydride or a diacid derived therefrom; and applying a major surface of a backing to at least a portion of the one or more cavities. Preferably, the composition is allowed to wet the major surface of the backing.

In another embodiment, the method of making an abrasive article includes providing a production tool having a three-dimensional body with one or more cavities; and applying to at least a portion of the one or more cavities a major surface of a backing having thereon a composition preparable by combining at least (a) an epoxy-functional material, and (b) at least one of a cyclic anhydride or a diacid derived therefrom.

The present invention provides a method of making abrasive articles. For some embodiments of the method, abrasive articles are made which preferably provide one or more of the following properties: superior wet grinding performance, superior stock removal rates, and superior abrasive life.

Definitions

As used herein, "binder precursor" means any material that is conformable or can be made to be conformable by heat or pressure or both and that can be rendered non-conformable by means of radiation energy or thermal energy or both. A binder precursor may include the polymeric material according to the present invention and optional materials including abrasive grits, fillers, and grinding aids.

As used herein, "binder" refers to a solidified, handleable material. Preferably, the binder is formed from reaction of a binder precursor to provide a material (e.g., particles) that will not substantially flow or experience a substantial change in shape. The expression "binder" does not require that the binder precursor is fully reacted (e.g., polymerized or cured), only that it is sufficiently reacted, for example, to allow removal thereof from the production tool while the production tool continues to move, without leading to substantial change in shape of the binder.

It should be understood that where incorporation of an ingredient is specified, either a single ingredient or a combination or mixture of materials may be used as desired. Similarly, articles including "a," "an," and, "the" are meant to be interpreted as referring to the singular as well as the plural. It should also be understood that the specification of a value that includes the term "about" is meant to include both higher and lower values reasonably close to the specified value. For example, for some properties values either 10% above or 10% below the specified value are intended to be included by use of the term "about".

DETAILED DESCRIPTION OF PREFERRED EMBODIMENTS OF THE INVENTION

Figure 1:
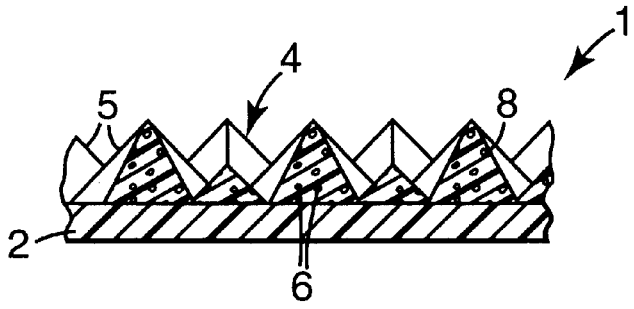
FIG. 1 is a side view in cross-section of an embodiment of an abrasive article according to the present invention.

An embodiment according to the present invention is illustrated in FIG. 1. Abrasive article 1 includes a backing 2 bearing on one major surface thereof abrasive projections 4. The abrasive projections 4 include a plurality of abrasive grits 6 dispersed in a binder 8. In this particular embodiment, the binder 8 bonds abrasive projections 4 to backing 2. In this embodiment each abrasive projection 4 has a discernible desired shape. For some embodiments of the invention, it is advantageous that the abrasive grits 6, if present, not protrude beyond the planes 5 of the shape before the abrasive article 1 is used. As the abrasive article 1 is being used to abrade a surface, the abrasive projections 4 generally break down revealing unused abrasive grits. Abrasive grits 6 are an optional component according to the method of the invention. The projection 4 would still be considered to be an abrasive projection even if abrasive grits 6 were not contained therein.

Polymeric materials useful for making binders useful for making abrasive articles according to the present invention include (1) a reaction product of components that include (a) an epoxy-functional material, (b) at least one of a cyclic anhydride or a diacid derived therefrom, and optionally (c) a polyfunctional (meth)acrylate; and/or (2) a polymeric material preparable by combining at least (a) an epoxy-functional material, (b) at least one of a cyclic anhydride or a diacid derived therefrom, and optionally (c) a polyfunctional (meth)acrylate. One or more polymeric materials may be used to make binders useful for making abrasive articles according to the present invention. Abrasive articles having polymeric materials therein are also disclosed in copending U.S. pat. application Ser. No. 09/812,174, filed on Mar. 20, 2001 and entitled "ABRASIVE ARTICLES HAVING A POLYMERIC MATERIAL" and U.S. pat. application Ser. No. 09/813,286, filed on Mar. 20, 2001 and entitled "DISCRETE PARTICLES THAT INCLUDE A POLYMERIC MATERIAL AND ARTICLES FORMED THEREFROM," both of which are incorporated herein by reference in their entireties.

Preferably, the components include at least about 1% by weight epoxy-functional material, more preferably at least about 20% by weight epoxy-functional material, and most preferably at least about 30% by weight epoxy-functional material, based on the total weight of the combination of epoxy-functional material, cyclic anhydride and/or diacid derived therefrom, and optional polyfunctional (meth) acrylate. Preferably, the components include at most about 90% by weight epoxy-functional material, more preferably at most about 80% by weight epoxy-functional material, and most preferably at most about 60% by weight epoxy-functional material, based on the total weight of the combination of epoxy-functional material, cyclic anhydride and/or diacid derived therefrom, and optional polyfunctional (meth)acrylate.

Preferably, the components include at least about 0.1 mole of cyclic anhydride and/or diacid derived therefrom, more preferably at least about 0.2 mole cyclic anhydride and/or diacid derived therefrom, and most preferably at least about 0.3 mole cyclic anhydride and/or diacid derived therefrom, per equivalent of epoxy functionality in the epoxy-functional material. Preferably, the components include at most about 1.3 moles of cyclic anhydride and/or diacid derived therefrom, more preferably at most about 1.0 mole cyclic anhydride and/or diacid derived therefrom, and most preferably at most about 0.8 mole cyclic anhydride and/or diacid derived therefrom, per equivalent of epoxy functionality in the epoxy-functional material.

If the components used to make a binder include polyfunctional (meth)acrylate, the components preferably include at least about 0.1% by weight polyfunctional (meth) acrylate, more preferably at least about 10% by weight polyfunctional (meth)acrylate, and most preferably at least about 20% by weight polyfunctional (meth)acrylate, based on the total weight of the combination of epoxy-functional material, cyclic anhydride and/or diacid derived therefrom, and polyfunctional (meth)acrylate. If the components used to make a binder include polyfunctional (meth)acrylate, the components preferably include at most about 80% by weight polyfunctional (meth)acrylate, more preferably at most about 70% by weight polyfunctional (meth)acrylate, and most preferably at most about 60% by weight polyfunctional (meth)acrylate, based on the total weight of the combination of epoxy-functional material, cyclic anhydride and/or diacid derived therefrom, and polyfunctional (meth)acrylate.

Epoxy-Functional Materials

Examples of epoxy-functional materials useful for making binders useful for making abrasive articles according to the present invention include octadecylene oxide, epichlorohydrin, styrene oxide, vinylcyclohexene dioxide (e.g., having the trade designation ERL-4206 from Union Carbide Corp., Danbury, Conn.), 3,4-epoxycyclohexylmethyl-3,4-epoxycyclohexene carboxylate (e.g., having the trade designation ERL-4221 from Union Carbide Corp., Danbury, Conn.), 2-(3,4-epoxycyclohexyl-5,5-spiro-3,4-epoxy) cyclohexane-metadioxane (e.g., having the trade designation ERL-4234 from Union Carbide Corp., Danbury, Conn.), bis(3,4-epoxy-cyclohexyl) adipate (e.g., having the trade designation ERL-4299 from Union Carbide Corp., Danbury, Conn.), dipentene dioxide (e.g., having the trade designation ERL-4269 from Union Carbide Corp., Danbury, Conn.), epoxidized polybutadiene (e.g., having the trade designation OXIRON 2001 from FMC Corp., Pasanda, Tex.), silicone resin containing epoxy functionality, epoxy silanes (e.g., beta-3,4-epoxycyclohexylethyltrimethoxy silane and 3-glycidoxypropyltrimethoxy silane, available from Union Carbide, Danbury, Conn.), glycidol, glycidylmethacrylate, diglycidyl ether of Bisphenol A (e.g., those available under the trade designations EPON 825, EPON 828, EPON 1004, and EPON 1001F from Resolution Performance Products, Houston, Tex., and DER-332 and DER-334 from Dow Chemical Co., Midland, Mich.), diglycidyl ether of Bisphenol F (e.g., having the trade designation ARALDITE GY281 from Vanitico, Inc., Brewster, N.Y.), flame retardant epoxy-functional materials (e.g., a brominated bisphenol type epoxy-functional material having the trade designation DER-542, available from Dow Chemical Co, Midland, Mich.), 1,4-butanediol diglycidyl ether (e.g., having the trade designation ARALDITE RD-2 from Vanitico, Inc., Brewster, N.Y.), hydrogenated bisphenol A-epichlorohydrin based epoxy-functional materials (e.g., having the trade designation EPONEX 1510 from Resolution Performance Products, Houston, Tex.), and polyglycidyl ether of phenol-formaldehyde novolak (e.g., having the trade designation DEN-431 and DEN-438 from Dow Chemical Co., Midland, Mich.), and triphenolmethane-epichlorohydrin based epoxy-functional material (e.g., having the trade designation TACTIX 742 from Vanitico, Inc., Brewster, N.Y.).

In certain embodiments according to the present invention 3,4-epoxycyclohexyl-methyl-3,4-epoxycyclohexene carboxylate (e.g., having the trade designation ERL-4221 from Union Carbide Corp., Danbury, Conn.) and epoxy-functional materials which are diglycidyl ethers of Bisphenol A (e.g., having the trade designations EPON 825, EPON 828, EPON 1001F, and EPON 1004 from Resolution Performance Products, Houston, Tex.) are particularly useful.

Cyclic Anhydrides and/or Diacids Derived Therefrom

Examples of cyclic anhydrides useful for making binders useful for making abrasive articles according to the present invention include maleic anhydride, succinic anhydride, hexahydrophthalic anhydride, tetrahydrophthalic anhydride, dodecylsuccinic anhydride, phthalic anhydride, nadic anhydride, pyromellitic anhydride, and mixtures thereof. A cyclic anhydride, which is particularly useful in certain embodiments of the invention, is hexahydrophthalic anhydride, which is available, for example, from Buffalo Chemical Color Corporation, Buffalo, N.Y.

Cyclic anhydrides may also be hydrolyzed to yield diacids derived therefrom. The diacids, although not preferred, are also useful for making binders useful for making abrasive articles according to the present invention.

Optional Polyfunctional (Meth)Acrylates

The term "(meth)acrylate," as used herein, encompasses acrylates and methacrylates. "Polyfunctional (meth) acrylate" means that, on average, the (meth)acrylate moiety has greater than about 1.0 equivalent of (meth)acrylate functionality per molecule.

Polyfunctional (meth)acrylates useful for making binders useful for making abrasive articles according to the present invention include, for example, ester compounds that are the reaction product of aliphatic or aromatic polyhydroxy compounds and (meth)acrylic acids. (Meth)acrylic acids are unsaturated carboxylic acids which include, for example, those represented by the following formula: $CH_2{=}C(R)C(O)OH$ where R is a hydrogen atom or a methyl group.

Polyfunctional (meth)acrylates can be monomers, oligomers, or polymers. For purposes of this invention, the term "monomer" means a molecule having a molecular weight less than about 400 Daltons and an inherent capability of forming chemical bonds with the same or other monomers in such manner that long chains (polymeric chains or macromolecules) are formed. For this application, the term "oligomer" means a molecule having 2 to 20 repeating units (e.g., dimer, trimer, tetramer, and so forth) having an inherent capability of forming chemical bonds with the same or other oligomers in such manner that longer polymeric chains can be formed therefrom. For this application, the term "polymer" means a molecule having greater than 20 repeating units having an inherent capability of forming chemical bonds with the same or other polymers in such manner that longer polymeric chains can be formed therefrom. The polyfunctional (meth)acrylate utilized according to the present invention may include, for example, polyfunctional (meth)acrylate monomers, polyfunctional (meth)acrylate oligomers, and polyfunctional (meth)acrylate polymers. For some embodiments, monomers and/or oligomers are particularly advantageous in that they tend to impart lower viscosities to the backing treatment composition than do polymers, which in some embodiments is advantageous for coating.

Useful polyfunctional (meth)acrylate monomers include, for example, ethylene glycol diacrylate, ethylene glycol dimethacrylate, hexanediol diacrylate, triethylene glycol diacrylate, trimethylolpropane triacrylate, ethoxylated trimethylolpropane triacrylate, glycerol triacrylate, pentaerthyitol triacrylate, pentaerythritol trimethacrylate, pentaerythritol tetraacrylate, pentaerythritol tetramethacrylate, and neopentylglycol diacrylate. For some embodiments, the polyfunctional (meth)acrylate monomer trimethylolpropane triacrylate can be particularly useful.

Useful polyfunctional (meth)acrylate monomers include, for example, trimethylolpropane triacrylate available, for example, under the trade designation SR351; ethoxylated trimethylolpropane triacrylate available, for example, under the trade designation SR454; pentaerythritol tetraacrylate available, for example, under the trade designation SR295; and neopentylglycol diacrylate available, for example, under the trade designation SR247; all available from Sartomer Co., Exton, Pa.

Useful polyfunctional (meth)acrylate oligomers include (meth)acrylated polyether and polyester oligomers. Examples of useful (meth)acrylated polyether oligomers include polyethylene glycol diacrylates available, for example, under the trade designations SR259 and SR 344 from Sartomer Co., Exton, Pa. Acrylated polyester oligomers are available, for example, under the trade designations EBECRYL 657 and EBECRYL 830 from UCB Specialty Chemicals, Smyrna, Ga.

Other useful polyfunctional (meth)acrylate oligomers include (meth)acrylated epoxies, for example, diacrylated esters of epoxy-functional materials (e.g., diacrylated esters of bisphenol A epoxy-functional material) and (meth) acrylated urethanes. Useful (meth)acrylated epoxies include, for example, acrylated epoxies available under the trade designations EBECRYL 3500, EBECRYL 3600, EBECRYL 3700, and EBECRYL 3720 from UCB Specialty Chemicals, Smyrna, Ga. Useful (meth)acrylated urethanes include, for example, acrylated urethanes available under the trade designations EBECRYL 270, EBECRYL 1290, EBECRYL 8301, and EBECRYL 8804 from UCB Specialty Chemicals, Smyrna, Ga.

Polyfunctional (meth)acrylate monomers, oligomers, and polymers each generally react to form a network due to multiple functionalities available on each monomer, oligomer or polymer.

Optional Additives

Free Radical Initiators. The term "free radical initiator" as used herein refers to a material that is capable of generating a free radical species that may cause at least partial reaction of polyfunctional (meth)acrylate. Examples of useful free radical initiators include free radical photoinitiators and free radical thermal initiators.

A free radical initiator may be included as a component to aid in reaction of the polyfunctional (meth)acrylate, if present, although it should be understood that an electron beam source also could be used to generate free radicals. A free radical initiator is preferably included when it is desired to react the polyfunctional (meth)acrylate prior to reaction of the epoxy-functional material with cyclic anhydride and/or diacid derived therefrom.

Actinic radiation (e.g., ultraviolet light and visible light), unlike radiative and non-radiative thermal energy sources, generally does not cause the epoxy-functional material to react with cyclic anhydride and/or diacid derived therefrom. In addition, the use of actinic radiation generally causes more rapid reacting of the polyfunctional (meth)acrylate than thermal energy sources. Radiative thermal sources include infrared and microwave sources. Non-radiative thermal sources include air impingement ovens. The temperature at which both reaction of the polyfunctional (meth) acrylate and reaction of the epoxy-functional material with cyclic anhydride and/or diacid derived therefrom occurs can vary but for some embodiments they both may occur, for example, at a temperature greater than about 50° C., or greater than about 60° C.

Increasing amounts of the free radical initiator generally results in an accelerated reaction rate of the polyfunctional (meth)acrylate, if present. Increased amounts of free radical initiator can also, for some embodiments, result in reduced energy exposure requirements for reaction of the polyfunctional (meth)acrylate to occur. The amount of the free radical initiator is generally determined by the rate at which it is desired for the polyfunctional (meth)acrylate to react, the intensity of the energy source, and the thickness of the composition.

Preferably, the components include at least about 0.1% by weight free radical initiator and more preferably at least about 0.4% by weight free radical initiator, based on the total weight of the combination of epoxy-functional material, cyclic anhydride and/or diacid derived therefrom, and optional polyfunctional (meth)acrylate. Preferably, the components include at most about 5% by weight free radical initiator, more preferably at most about 4% by weight free radical initiator, and most preferably at most about 2% by weight free radical initiator, based on the total weight of the combination of epoxy-functional material, cyclic anhydride and/or diacid derived therefrom, and optional polyfunctional (meth)acrylate.

Free Radical Photoinitiators. Examples of useful photoinitiators, which generate free radicals when exposed to ultraviolet light, include organic peroxides, azo compounds, quinones, benzophenones, nitroso compounds, acyl halides, hydrazones, mercapto compounds, pyrylium compounds, triacylimidazoles, acylphosphine oxides, bisimidazoles, chloroalkyltriazines, benzoin ethers, benzil ketals, thioxanthones, acetophenone derivatives, and mixtures thereof. An example of a useful free radical-generating initiator for use with ultraviolet light is 2,2-dimethoxy-2-phenylacetophenone initiator available, for example, under the trade designation IRGACURE 651 from Ciba Specialty Chemicals, Tarrytown, N.Y. Examples of photoinitiators that generate free radicals when exposed to visible radiation, are described in U.S. Pat. No. 4,735,632 (Oxman et al.).

Free Radical Thermal Initiators. Free radical thermal initiators useful for the present invention include azo, peroxide, persulfate, and redox initiators.

Suitable azo initiators include 2,2'-azobis(4-methoxy-2,4-dimethylvaleronitrile) (available under the trade designation VAZO 33); 2,2'-azobis(2-amidinopropane) dihydrochloride (available under the trade designation VAZO 50); 2,2'-azobis(2,4-dimethylvaleronitrile) (available under the trade designation VAZO 52); 2,2'-azobis(isobutyronitrile) (available under the trade designation VAZO 64); 2,2'-azobis-2-methylbutyronitrile (available under the trade designation VAZO 67); 1,1'-azobis(1-cyclohexanecarbonitrile) (available under the trade designation VAZO 88), all of which are available from E.I. Dupont deNemours and Company, Wilmington, Del., and 2,2'-azobis(methyl isobutyrate) (available under the trade designation V-601 from Wako Pure Chemical Industries, Ltd., Osaka, Japan).

Suitable peroxide initiators include benzoyl peroxide, acetyl peroxide, lauroyl peroxide, decanoyl peroxide, dicetyl peroxydicarbonate, di(4-t-butylcyclohexyl) peroxydicarbonate (available under the trade designation PERKADOX 16, from Akzo Chemicals, Inc., Chicago, Ill.), di(2-ethylhexyl) peroxydicarbonate, t-butylperoxypivalate (available under the trade designation LUPERSOL 11, from Lucidol Division., Atochem North America, Buffalo, N.Y.) t-butylperoxy-2-ethylhexanoate (available under the trade designation TRIGONOX 21 -C50, from Akzo Chemicals, Inc., Chicago, Ill.), and dicumyl peroxide.

Suitable persulfate initiators include potassium persulfate, sodium persulfate, and ammonium persulfate.

Suitable redox (oxidation-reduction) initiators include combinations of persulfate initiators with reducing agents including, for example, sodium metabisulfite and sodium bisulfite; systems based on organic peroxides and tertiary amines (e.g., benzoyl peroxide plus dimethylaniline); and systems based on organic hydroperoxides and transition metals (e.g., cumene hydroperoxide plus cobalt naphthenate).

Curing Agents. The components used in the present invention may further include a curing agent that promotes reaction of the epoxy-functional material with the cyclic anhydride and/or diacid derived therefrom. The term "curing agent" as used herein refers to a material that increases the rate of reaction of the cyclic anhydride and/or diacid derived therefrom with the epoxy-functional material. The cyclic anhydride and/or diacid derived therefrom are excluded from the definition of "curing agent." Examples of suitable curing agents include, for example, catalysts and curatives. A "catalyst" is a curing agent that increases the rate of such a reaction but is not incorporated into the reaction product of the epoxy-functional material with cyclic anhydride and/or diacid derived therefrom. A "curative" is a curing agent that increases the rate of such a reaction and is incorporated into the reaction product of the epoxy-functional material with cyclic anhydride and/or diacid derived therefrom.

The reaction of the cyclic anhydride and/or diacid derived therefrom with epoxy-functional material generally results in ester linkages. The curing agent may be activated, for example, by exposure to ultraviolet or visible light radiation, by accelerated particles (e.g., electron beam radiation), or thermally (e.g., radiative and non-radiative sources).

If desired, the polyfunctional (meth)acrylate, if present, may be reacted prior to reaction of the epoxy-functional material with cyclic anhydride and/or diacid derived therefrom. A type of energy source and curing agent is preferably selected that would not cause the epoxy-functional material to react with cyclic anhydride and/or diacid derived therefrom simultaneously with the reaction of the polyfunctional (meth)acrylate. It is advantageous for certain embodiments to react the polyfunctional (meth)acrylate using ultraviolet or visible light radiation and a free radical photoinitiator followed by reaction of the epoxy-functional material with cyclic anhydride and/or diacid derived therefrom via a thermal energy source using a thermal curing agent. Epoxy-functional materials, cyclic anhydrides, and/or diacids derived therefrom are not free radically curable and thus would not generally be affected by the reaction of the polyfunctional (meth)acrylate via ultraviolet light radiation unless the light generates a significant amount of heat. Preferably, the components include at least about 0.1% by weight curing agent and more preferably at least about 0.4% by weight curing agent, based on the total weight of the combination of epoxy-functional material, cyclic anhydride and/or diacid derived therefrom, and optional polyfunctional (meth)acrylate. Preferably, the components include at most about 20% by weight curing agent, more preferably at most about 4% by weight curing agent, and most preferably at most about 3% by weight curing agent, based on the total weight of the combination of epoxy-functional material, cyclic anhydride and/or diacid derived therefrom, and optional polyfunctional (meth)acrylate. For some embodiments it may not be desired to react the polyfunctional (meth)acrylate prior to reaction of the epoxy-functional material with cyclic anhydride and/or diacid derived therefrom. A thermal curing agent, a thermal free radical initiator, and a thermal energy source may be used, for example, in such an embodiment.

Increasing amounts of the curing agent generally results in an accelerated reaction rate of the epoxy-functional material with cyclic anhydride and/or diacid derived therefrom. Increased amounts of curing agent generally also result in reduced energy exposure requirements for reaction of the epoxy-functional material with cyclic anhydride and/or diacid derived therefrom to occur and a shortened pot life at application temperatures. The amount of the curing agent is generally determined by the rate at which it is desired for the composition to cure, the intensity of the energy source, and the thickness of the composition.

Examples of useful curing agent catalysts include thermal catalysts and photocatalysts.

Thermal Catalyst Curing Agents. Examples of useful thermal catalyst curing agents include those selected from the group consisting of Lewis acids and Lewis acid complexes including aluminum trichloride; aluminum tribromide; boron trifluoride; boron trichloride; antimony pentafluoride; titanium tetrafluoride; and boron trifluoride and boron trichloride complexes including, for example, $BF_3$.diethylamine and a $BCl_3$.amine complex available under the trade designation OMICURE BC-120 from CVC Specialty Chemicals, Inc., Maple Shade, N.J.

Additional useful thermal catalyst curing agents include aliphatic and aromatic tertiary amines including, for example, dimethylpropylamine, pyridine, dimethylaminopyridine, and dimethylbenzylamine; imidazoles including, for example, 2-ethylimidazole, and 2-ethyl-4-methylimidazole (available under the trade designation IMICURE EMI-2,4 from Air Products, Allentown, Pa.), hydrazides including, for example, aminodihydrazide; guanidines including, for example, tetramethyl guanidine; and dicyandiamide.

Photocatalyst Curing Agents. The curing agent can, for example, be a cationic photocatalyst activated by actinic radiation (e.g., ultraviolet light and visible light).

Useful cationic photocatalysts are generally either protic or Lewis acids. Useful cationic photocatalysts include salts having onium cations and halogen-containing complex anions of a metal or metalloid (e.g., aryl sulfonium salts available under the trade designations CYRACURE UVI-6974 and CYRACURE UVI-6976 from Union Carbide Corporation, Danbury, Conn.). Other useful cationic photocatalysts include metallocene salts having organometallic complex cations and halogen-containing complex anions of a metal or metalloid which are further described in U.S. Pat. No. 4,751,138 (Tumey et al.). Another useful cationic catalyst is the combination of an organometallic salt and an onium salt described in U.S. Pat. No. 4,985,340 (Palazotto et al.), and European Pat. Publ. Nos. 306,161 (Palazotto et al.), published Mar. 8, 1989; and 306,162 (Palazotto et al.), published Mar. 8, 1989. Still other useful cationic photocatalysts include ionic salts of organometallic complexes in which the metals are selected from the elements of Periodic Groups, IVB, VB, VIB, VIIB, and VIII which are described in European Pat. Publ. No. 109,851 (Palazotto et al.), published May 30, 1984.

Curatives. Other useful curing agents, for certain embodiments, include aliphatic and aromatic amine curatives. Examples of aliphatic amine curatives include ethanolamine; 1,2-diamino-2-methyl-propane; 2,3-diamino-2-methyl-butane; 2,3-diamino-2-methyl-pentane; 2,4-diamino-2,6-dimethyloctane; and dibutylamine dioctylamine. Examples of aromatic amine curatives include o-phenylene diamine; 4,4-diaminodiphenyl sulfone; 3,3'-diaminodiphenyl sulfone; 4,4'-diaminodiphenylsulfide; 4,4'-diaminodiphenyl ketone; 4,4'-diaminodiphenyl ether; 4,4'-diaminodiphenyl methane; and 1,3-propanediol-bis(4-aminobenzoate). Aromatic amine curatives are advantageous in certain embodiments as they generally provide improved properties for the resulting polymeric material than do aliphatic amine curatives.

Increasing amounts of curing agent generally results in an accelerated reaction rate of the epoxy-functional material with cyclic anhydride and/or diacid derived therefrom. Increased amounts of curing agent generally also result in reduced energy exposure requirements for reaction of the epoxy-functional material with cyclic anhydride and/or diacid derived therefrom to occur and a shortened pot life at application temperatures. The amount of the curing agent is generally determined by the rate at which it is desired for the composition to cure, the intensity of the energy source, and the thickness of the composition.

As mentioned previously, a curing agent is an optional component. Preferably, the components include at least about 0.1% by weight curing agent and more preferably at least about 0.4% by weight curing agent, based on the total weight of the combination of epoxy-functional material, cyclic anhydride and/or diacid derived therefrom, and optional polyfunctional (meth)acrylate. Preferably, the components include at most about 20% by weight curing agent and more preferably at most about 10% by weight curing agent, based on the total weight of the combination of epoxy-functional material, cyclic anhydride and/or diacid derived therefrom, and optional polyfunctional (meth) acrylate.

Other Functional Additives. The polymeric material according to the present invention may optionally include one or more additives in addition to the (1) reaction product of components that include (a) an epoxy-functional material, (b) at least one of a cyclic anhydride or a diacid derived therefrom; and/or (2) polymeric material preparable by combining at least (a) an epoxy-functional material, and (b) at least one of a cyclic anhydride or a diacid derived therefrom. Useful additives include fillers (including grinding aids, for example), fibers, lubricants, wetting agents, surfactants, pigments, dyes, coupling agents, plasticizers, antistatic agents, and suspending agents. Compositions according to the present invention may also optionally include water or an organic solvent.

A filler, if included, preferably should not adversely affect the bonding characteristics of the polymeric material. Examples of fillers suitable for this invention include metal carbonates, including calcium carbonate (e.g., chalk, calcite, marl, travertine, marble, and limestone), calcium magnesium carbonate, sodium carbonate, and magnesium carbonate; silica, including amorphous silica, quartz, glass beads, glass bubbles, and glass fibers; silicates, including talc, clays (e.g., montmorillonite), feldspar, mica, calcium silicate, calcium metasilicate, sodium aluminosilicate, and sodium silicate; metal sulfates, including calcium sulfate, barium sulfate, sodium sulfate, aluminum sodium sulfate, aluminum sulfate; gypsum; vermiculite; wood pulp; aluminum trihydrate; metal oxides, including calcium oxide (lime), aluminum oxide, titanium dioxide; and metal sulfites, including calcium sulfite. If filler is present, the polymeric material preferably includes at least about 20% by weight filler based on the total weight of the polymeric material. If filler is present, the polymeric material preferably includes at most about 80% by weight filler based on the total weight of the polymeric material.

A grinding aid is generally a particulate material that has a significant effect on the chemical and physical processes of abrading, thereby resulting in improved performance. In particular, although not wanting to be bound by theory, it is believed that the grinding aid may (1) decrease the friction between the abrasive grits and the workpiece being abraded, (2) prevent the abrasive grits from "capping, " i.e., prevent metal particles from becoming welded to the tops of the abrasive grits when the abrasive article is used on a metal workpiece, (3) decrease the interface temperature between the abrasive grits and the workpiece, or (4) decrease the grinding forces. In general, the addition of a grinding aid generally increases the useful life of the abrasive article. Grinding aids encompass a wide variety of different materials and can be inorganic or organic. Examples of useful grinding aids include waxes, organic halide compounds, halide salts, and metals and their alloys. The organic halide compounds will generally break down during abrading and release a halogen acid or a gaseous halide compound. Examples of such materials include, for example, chlorinated waxes (e.g., tetrachloronaphthalene, pentachloronaphthalene, and poly(vinyl chloride)). Examples of halide salts include sodium chloride, potassium cryolite, sodium cryolite, ammonium cryolite, potassium tetrafluoroborate, sodium tetrafluoroborate, silicon fluorides, potassium chloride, and magnesium chloride. Examples of metals include tin, lead, bismuth, cobalt, antimony, cadmium, iron, and titanium. Other grinding aids include sulfur, organic sulfur compounds, graphite, and metallic sulfides. It is also within the scope of this invention to use a combination of different grinding aids and, in some instances, this may produce a synergistic effect. The above-mentioned examples of grinding aids is meant to be a representative showing of grinding aids, and it is not meant to encompass all grinding aids.

Examples of useful antistatic agents include graphite, carbon black, vanadium oxide, humectants, conductive polymers, and the like. These antistatic agents are disclosed in U.S. Pat. No. 5,061,294 (Harmer et al.); U.S. Pat. No. 5,137,542 (Buchanan et al.); and U.S. Pat. No. 5,203,884 (Buchanan et al.).

Examples of useful coupling agents include silanes, titanates, and zircoaluminates. A useful silane coupling agent is 3-methacryloxypropyltrimethoxysilane, available, for example, under the trade designation A-174 from OSI Specialties, Inc. (Friendly, W.Va.). U.S. Pat. No. 4,871,376 (DeWald) describes reducing viscosity of resin/filler dispersions by utilizing a silane coupling agent.

If the particle contains abrasive grits, it is preferred that the particle be capable of breaking down during abrading. The selection and amount of the binder precursor, abrasive grits, and optional additives will influence the breakdown characteristics of the particle.

Combined Components

Compositions useful for making binders useful for making abrasive articles according to the present invention may be prepared by combining at least an epoxy-functional material; at least one of a cyclic anhydride and/or diacid derived therefrom; and optionally a polyfunctional (meth) acrylate.

In certain embodiments of the invention, the optional polyfunctional (meth)acrylate serves as a viscosity modifier to the composition after the polyfunctional (meth)acrylate has been at least partially reacted, which allows, for example, better control of the flow of the composition. For example, for certain embodiments, it is preferred to at least partially react the optional polyfunctional (meth)acrylate component prior to at least partially reacting the epoxy-functional material with cyclic anhydride and/or diacid derived therefrom. This at least partial reaction generally causes a large increase in viscosity of the composition. This generally limits the movement of the composition prior to at least partial reaction of the epoxy-functional material with cyclic anhydride and/or diacid derived therefrom. For certain embodiments, this is accomplished by subjecting the composition to an energy source that causes the optional polyfunctional (meth)acrylate to at least partially react, prior to at least partially reacting the epoxy-functional material with cyclic anhydride and/or diacid derived therefrom. Various energy sources and initiator combinations, discussed in more detail later herein, including, for example, ultraviolet light and e-beam radiation, can be selected to provide for certain embodiments at least partial reaction of the optional polyfunctional (meth)acrylate prior to at least partial reaction of the epoxy-functional material with cyclic anhydride and/or diacid derived therefrom. The method according to the present invention in certain embodiments allows for fewer composition applications, less energy for curing and lower raw material costs than conventional methods.

The percent solids of the composition utilized according to the present invention can vary. The percent solids of the composition is preferably at least about 50%, more preferably at least about 60%, even more preferably at least about 70%, even more preferably at least about 80%, even more preferably at least about 90%, and even more preferably at least about 95%. The percent solids of the composition is most preferably about 100%. A higher percent solids generally results in a faster curing composition. The term "percent solids" is readily understood and is capable of being determined by one skilled in the art.

Backing

Materials suitable for the backing according to the method of the present invention include polymeric film, paper, cloth, metallic film, vulcanized fiber, nonwoven substrates, combinations of the foregoing, and treated versions of the foregoing. For some embodiments, it may be advantageous for the backing be a polymeric film (e.g., a polyester film). For some embodiments, it may be advantageous for the backing to be substantially transparent to ultraviolet radiation. For some embodiments, it may be advantageous that the film be primed with a material, for example, polyethylene acrylic acid, to promote adhesion of the composition having projections therein to the backing.

The backing can optionally be laminated to another substrate after the abrasive article is formed. For example, a flexible backing can be laminated to a stiffer, more rigid substrate, (e.g., a metal plate).

The surface of the backing opposite the abrasive projections (or a substrate adhered to the backing) may, for example, have a pressure-sensitive adhesive coated thereon or one part of a two-part hook and loop type attachment system secured thereto so that the abrasive article can be secured to a back-up pad. Examples of pressure-sensitive adhesives suitable for this purpose include rubber-based pressure sensitive adhesives, (meth)acrylate-based pressure sensitive adhesives, and silicone-based pressure sensitive adhesives.

Abrasive Grits

The term "abrasive grits" as used herein includes, for example, individual abrasive grits as well as multiple individual abrasive grits bonded together to form an abrasive agglomerate. Abrasive agglomerates are described, for example, in U.S. Pat. No. 4,311,489 (Kressner); U.S. Pat. No. 4,652,275 (Bloecher et al.); and U.S. Pat. No. 4,799,939 (Bloecher et al.).

In one particularly useful embodiment, the composition may contain abrasive grits. The polymeric material can function to bond the abrasive grits together to form an abrasive particle. The abrasive grits preferably have an average particle size of at least about 0.1 micrometer and more preferably at least about 1 micrometer. The abrasive grits preferably have an average particle size of at most about 1500 micrometers, more preferably at most about 1300 micrometers, and most preferably at most about 500 micrometers. The Moh's hardness of the abrasive grits can vary. The Moh's hardness of the abrasive grits is preferably at least about 5, more preferably at least about 6, even more preferably at least about 7, even more preferably at least about 8, and most preferably at least about 9. Examples of materials of such abrasive grits include aluminum oxide (e.g., fused aluminum oxide, ceramic aluminum oxide, white fused aluminum oxide, and heat treated aluminum oxide), silica, silicon carbide (e.g., green silicon carbide), alumina zirconia, zirconium oxide, diamond, ceria, cubic boron nitride, garnet, and tripoli. The ceramic aluminum oxide can be made, for example, according to a sol gel process as described, for example, in U.S. Pat. No. 4,314,827 (Leitheiser et al.); U.S. Pat. No. 4,744,802 (Schwabel); U.S. Pat. No. 4,623,364 (Cottringer et al.); U.S. Pat. No. 4,770,671 (Monroe et al.); 4,881,951 (Wood et al.); U.S. Pat. No. 5,011,508 (Wald et al.); and U.S. Pat. No. 5,213,591 (Celikkaya et al.). Ceramic aluminum oxides include, for example, alpha alumina and, optionally, a metal oxide modifier, including, for example, magnesia, zirconia, zinc oxide, nickel oxide, hafnia, yttria, silica, iron oxide, titania, lanthanum oxide, ceria, and neodynium oxide. The ceramic aluminum oxide may also optionally include a nucleating agent, including, for example, alpha alumina, iron oxide, iron oxide precursor, titania, chromia, and combinations thereof The ceramic aluminum oxide may also have a shape as described, for example, in U.S. Pat. No. 5,201,916 (Berg et al.) and U.S. Pat. No. 5,090,968 (Pellow).

The abrasive grit may also have a surface coating. A surface coating can improve the adhesion between the abrasive grit and the polymeric material and/or can alter the abrading characteristics of the abrasive grit. Such surface coatings are described in U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 4,997,461 (Markhoff-Matheny et al.); U.S. Pat. No. 5,213,591 (Celikkaya et al.); and U.S. Pat. No. 5,042,991 (Kunz et al.). An abrasive grit may also contain a coupling agent on its surface, for example, a silane coupling agent.

The composition, may, for example, contain a single type of abrasive grit, two or more types of different abrasive grits, or at least one type of abrasive grit with at least one type of diluent material. Examples of materials for diluents include calcium carbonate, glass bubbles, glass beads, greystone, marble, gypsum, clay, $SiO_2$, $KBF_4$, $Na_2$ $SiF_6$, cryolite, organic bubbles, organic beads, and the like.

The weight percentages of the abrasive grits and the polymeric material in the particle according to the present invention will depend on several factors, for example, the intended use of the abrasive article and the particle size and distribution of the abrasive grit. Preferably, the abrasive grits, if included, will be at least about 5% by weight and more preferably at least about 20% by weight, based on the total weight of the abrasive layer. Preferably, the abrasive grits, if included, will be at most about 95% by weight and more preferably at most about 75% by weight, based on the total weight of the abrasive layer. Preferably, the polymeric material will be at least about 5% by weight and more preferably at least about 25% by weight, based on the total weight of the abrasive layer. Preferably, the polymeric material will be at most about 95% by weight and more preferably at most about 80% by weight, based on the total weight of the abrasive layer.

Projections

The abrasive projections preferably have at least one predetermined shape and are disposed in a predetermined array. Preferably, the predetermined shapes of the abrasive projections repeat themselves with a certain periodicity. This repeating shape is preferably in one direction or, more preferably, in two directions. Preferably there is no random pattern, i.e., a very clear and definite repeating pattern is present. Preferably, the projections are in an array having a non-random pattern. The abrasive projections may preferably be formed from a composition provided by combining at least an epoxy-functional material and at least one of a cyclic anhydride or a diacid derived therefrom, optionally having a plurality of abrasive grits dispersed therein. Preferably, upon at least partially curing, the abrasive projections are set, i.e., fixed, in the predetermined shape and predetermined array.

Preferably, the abrasive projections have a shape that has been formed by curing the composition while the composition is both being borne on a backing and filling a cavity on the surface of a production tool. Preferably, an abrasive projection has the same, or substantially the same, shape as that of the cavity. A plurality of such projections preferably provides three-dimensional shapes that project outward from the surface of the backing, preferably in a non-random pattern, which is preferably the inverse of the pattern of the production tool, for example. Each projection is preferably defined by a boundary, the base portion of the boundary preferably being the interface with the backing to which the projection is adhered. The remaining portion of the boundary is preferably defined by the cavity on the surface of a production tool in which the projection was cured. The entire outer surface of the projection is preferably confined, either by the backing or by the cavity, during its formation.

The spaces between the projections preferably provide means for escape of the swarf from the abrasive article, thereby potentially reducing loading and the amount of heat built up during use. Additionally, the abrasive article in some embodiments preferably exhibits uniform wear and uniform grinding forces over its surface. In some embodiments, as the abrasive article is used abrasive grits are sloughed off and new abrasive grits are exposed, preferably resulting in an abrasive product having a long life, high sustained cut rate, and consistent surface finish over the life of the product.

The projections may optionally have a variety of shapes (e.g., pyramidal) as desired. Before use, it is preferred that any individual abrasive grits in a projection do not project beyond the boundary which defines the shape of such projection. The dimensions of a given shape are preferably substantially determined as desired. Furthermore, the composites are preferably disposed on the backing in a non-random array. The non-random array preferably exhibits some degree of repetitiveness. The repeating pattern of an array may preferably be in linear form or in the form of a matrix, for example.

Figure 3:
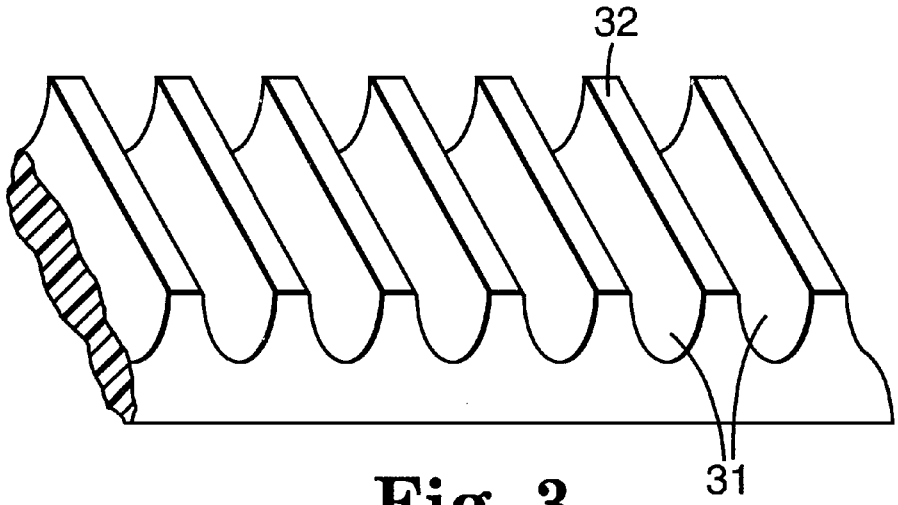
FIG. 3 is a perspective view of an embodiment of an abrasive article according to the present invention.

Abrasive projections disposed in a predetermined array may preferably have a wide variety of shapes and periods including, for example, linear curved projections, linear angled projections and pyramidal, cylindrical, and prism shapes. FIG. 1 shows projections 4 of like size and shape and illustrates a structured surface made up of trihedral prism elements. FIG. 3 shows a series of linear projections 31 and lands 32.

Each projection preferably has a boundary, which is defined by one or more planar surfaces. For example, in FIG. 1 the planar boundary is designated by reference numeral 5. In some embodiments the abrasive grits, if present, do not project above the planar boundary. Although not wishing to be bound by theory, it is believed that such a construction preferably allows an abrasive article to decrease the amount of loading resulting from grinding swarf.

The optimum shape of a projection preferably depends upon the particular abrading application. When the areal density of the projections, i.e., number of projections per unit area, is varied, different properties may preferably be achieved. For example, a higher areal density preferably produces a lower unit pressure per projection during grinding, thereby allowing a finer surface finish. An array of continuous peaks may preferably be disposed so as to result in a flexible product. For off hand grinding applications, it may be advantageous for certain embodiments that the aspect ratio (i.e., the ratio of the height to the base) of the abrasive projections be about 0.3 to about 1. For some embodiments according to the present invention it may be advantageous for the maximum distance between corresponding points on adjacent projections to be less than one millimeter, and even less than 0.5 millimeter.

Production Tools

The production tool is preferably a three-dimensional body having at least one continuous surface. Preferably at least one opening, more preferably a plurality of openings, are present in the continuous surface. Each opening preferably provides access to a cavity formed in the three-dimensional body. As used in this context, the term "continuous" means characterized by uninterrupted extension in space; the openings and cavities are features in the continuous surface, but they do not break the surface into a plurality of individual surfaces. The production tool is preferably in the form of a web, a belt, e.g., an endless belt, a sheet, a coating roll, or a sleeve mounted on a coating roll. Preferably the production tool is one that allows continuous operations, including, for example, an endless belt or a cylindrical coating roll that rotates about an axis. Preferably, a cylindrical coating roll has a diameter of about 25 cm to about 45 cm and is constructed of a rigid material. Useful materials for a production tool include, for example, polyolefin polymers (e.g., polypropylene) and metals (e.g., nickel). The production tool can also be formed from a ceramic material, for example.

A production tool made of metal may preferably be fabricated, for example, by engraving, photolithography, hobbing, etching, knurling, assembling a plurality of metal parts machined in the desired configuration, die punching, or by electroforming. A frequently used method for preparing a metal production tool or master tool is diamond turning. These techniques are further described in the *Encyclopedia of Polymer Science and Technology,* Vol. 8, John Wiley & Sons, Inc., 651–65 (1968) and U.S. Pat. No. 3,689,346, (Rowland) col. 7, lines 30 to 55. The production tool may also contain a release coating to permit easier removal of the projections from the cavities and to minimize wear of the production tool. Examples of such release coatings include hard coatings including, for example, metal carbides, metal nitrides, metal borides, diamond, or diamond-like carbon. It is also within the scope of this invention to use a heated production tool, which is generally made from metal. A heated tool may allow easier processing, more rapid curing, and easier release of the projections from the tool.

In some instances, a polymeric production tool can be replicated from an original master tool. This is most frequently done when the production tool is in the form of a belt or web. One general advantage of polymeric tools over metal tools is cost. Another general advantage of polymeric tools is the capability of allowing radiation to pass from the radiation source through the production tool and into the composition. A polymeric production tool can be prepared, for example, by coating a molten thermoplastic resin, (e.g., polypropylene) onto the master tool. The molten resin can then be quenched to give a thermoplastic replica of the master tool. This polymeric replica can then be utilized as the production tool. Additionally, the surface of the production tool may contain a release coating, for example, a silicone-based material or fluorochemical-based material, to improve the releasability of the projections from the production tool. It is also within the scope of this invention to incorporate a release agent into the polymer from which the production tool is formed. Suitable release agents include silicone-based materials and fluorochemical-based materials. It is within the scope of this invention to prepare production tools from polymers that exhibit good release characteristics. Such a polymer is described in U.S. Pat. No. 5,314,959 (Rolando et al.). That document describes a fluorochemical graft copolymer including a base polymer including polymerized units derived from monomers having terminal olefinic double bonds, having a moiety including a fluoroaliphatic group grafted thereto. The grafted fluoroaliphatic group is generally derived from a fluorochemical olefin including a fluoroaliphatic group and a polymerizable double bond.

The fluoroaliphatic group of the fluorochemical olefin is generally bonded to the polymerizable double bond through a linking group. Such fluorochemical olefins can be represented, for example, by the following formula:

$$(R_f)_aQ(CR{=}CH_2)_b$$

wherein R represents hydrogen, trifluoromethyl, or straight-chain or branched-chain alkyl group including 1 to 4 carbon atoms;

a represents an integer from 1 to 10;

b represents an integer from 1 to 6;

Q represents an (a+b)-valent linking group that does not substantially interfere with free radical polymerization; and $R_f$ represents a fluoroaliphatic group including a fully fluorinated terminal group including at least seven fluorine atoms.

The metal master tool can be made by the same methods that can be used to make metal production tools. Other methods of preparing production tools are described, for example, in U.S. Pat. No. 5,435,816 (Spurgeon et al.).

Polymeric tools are described in U.S. Pat. No. 5,435,816 (Spurgeon et al.). If the production tool is made from a thermoplastic material, the conditions of the method should generally be set such that any heat generated in the curing zone does not adversely affect the production tool.

As mentioned previously, preferably at least one continuous surface of the production tool contains at least one cavity, more preferably a plurality of cavities. The binder precursor will generally acquire a shape corresponding to the shape of the cavities. A cavity can have any shape including, for example, an irregular shape of a geometric shape (e.g., pyramid, prism, cylinder, and cone). Pyramids generally have bases having three or four sides. The geometric shapes can be truncated versions of the foregoing. It is also within the scope of this invention that a given production tool may contain a variety of cavities of different shapes or cavities of different sizes or both. In the case of a web or belt, the cavity can extend completely through the production tool. The cavities can abutt or have land areas between them. The sides of the cavities may have a slope associated with them to allow easier removal of the binder from the production tool. There may, however, be minor imperfections in the projections that are introduced when the articles are removed from the cavities. If the composition is not sufficiently cured in the cavities, the composition will generally flow, and the resulting shape will generally not correspond to the shape of the cavities. This lack of correspondence may give an undesired and irregular shape to the projection.

Methods

Abrasive articles can be prepared according to a number of embodiments of the method of the invention. A non-limiting embodiment of the method is as follows. A composition provided by combining at least an epoxy-functional material; at least one of a cyclic anhydride or a diacid derived therefrom; and abrasive grits is introduced into the cavities of a production tool. A backing having a front side and a back side is introduced to the outer surface of the composition filled production tool. The composition wets the front side of the backing to form an intermediate article. The composition is preferably at least partially cured, or gelled, before the intermediate article is removed from the outer surface of the production tool. The abrasive article is subsequently removed from the production tool. For certain embodiments, it may be advantageous to carry out the aforementioned in a continuous manner.

Figure 2:
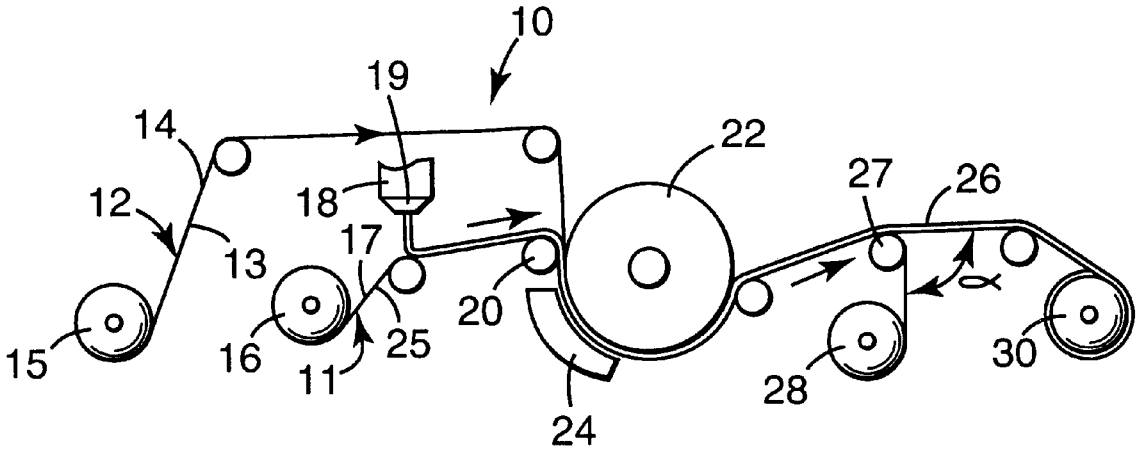
FIG. 2 is a schematic view of an apparatus for making an embodiment of an abrasive article according to the present invention.

FIG. 2 illustrates an apparatus 10 for making an abrasive article. A production tool 11 is in the form of a roll having two major surfaces and two ends. A backing 12 having a front surface 13 and a back surface 14 leaves an unwind station 15. At the same time, the production tool 11 leaves an unwind station 16. The contacting surface 17 of production tool 11 is coated with composition 19 provided by combining at least an epoxy-functional material; at least one of a cyclic anhydride or a diacid derived therefrom; and optionally a plurality of abrasive grits at coating station 18. The composition can be heated to lower the viscosity thereof prior to the coating step. The coating station 18 can include any conventional coating means, including, for example, knife coater, drop die coater, curtain coater, vacuum die coater, or an extrusion die coater. After the contacting surface 17 of production tool 11 is coated, the backing 12 and the production tool 11 are brought together such that the composition wets the front surface 13 of the backing 12. In FIG. 2, the composition is forced into contact with the backing 12 by means of a contact nip roll 20, which also forces the production tool/composition/backing construction against a support drum 22. Next, a sufficient dose of radiation energy is transmitted by a source of radiation energy 24 through the back surface 25 of production tool 11 and into the composition to at least partially cure the binder precursor, thereby forming a shaped, handleable structure 26. The production tool 11 is then separated from the shaped, handleable structure 26. Separation of the production tool 11 from the shaped, handleable structure 26 occurs at roller 27. The angle a between the shaped, handleable structure 26 and the production tool 11 immediately after passing over roller 27 is preferably steep, e.g., in excess of 30°, in order to bring about clean separation of the shaped, handleable structure 26 from the production tool 11. The production tool 11 is rewound on mandrel 28 so that it can be reused. Shaped, handleable structure 26 is wound on mandrel 30. If the binder precursor has not been fully cured, it can then be fully cured by exposure to an additional energy source (e.g., a source of thermal energy or an additional source of radiation energy) to form the coated abrasive article. Alternatively, full cure may eventually result without the use of an additional energy source to form the coated abrasive article. As used herein, the phrase "full cure" means that the binder precursor is sufficiently cured so that the resulting product will function as an abrasive article, e.g., a coated abrasive article.

It is preferred that composition 19 be heated prior to entering production tool 11, preferably at a temperature of about 20° C. to about 50° C., more preferably about 30° C. to about 40° C. When composition 19 is heated, it generally flows more readily into the cavities of production tool 11, thereby minimizing imperfections. The viscosity of the composition 19 is generally closely controlled for several reasons. For example, if the viscosity is too high, it may be difficult to apply the composition 19 to the production tool 11.

In order to form a mixture including a binder precursor and other materials, (e.g., abrasive grits), the components can be mixed together by any conventional technique, including, for example high shear mixing, air stirring, or tumbling. A vacuum can be used on the mixture during mixing to minimize entrapment of air.

The composition can be introduced to the cavities of the production tool by a dispensing means that utilizes any conventional technique, including, for example, gravity feeding, pumping, die coating, or vacuum drop die coating. The composition can also be introduced to the cavities of the production tool by transfer via a carrier web. The composition can be subjected to ultrasonic energy during the mixing step or immediately prior to the coating step in order to lower the viscosity of the composition.

Although the composition generally only needs to fill a portion of a cavity when a production tool is used in making the projections, the composition preferably completely fills the cavities in the surface of the production tool, so that the resulting projections will contain few voids or imperfections. These imperfections sometimes cause the shape of the projections to depart from the generally desired shape. Additionally, when a binder material is removed from the production tool, an edge may break off, thereby creating an imperfection and detracting from the shape. Preferably, care is taken throughout the process to minimize such imperfections. Sometimes, however, voids or imperfections are desirable, because they create porosity in the resultant projections, thereby causing the projections to have greater erodibility. For some embodiments, it is desirable that the composition not extend substantially beyond the openings of the cavities of the production tool.

The step following the introduction of the composition into the cavities of the production tool preferably involves at least partially curing the composition by exposing it to radiation energy and/or thermal energy while it is present in the cavities of the production tool. Alternatively, the composition can be at least partially cured while it is present in the cavities of the production tool, and then post-cured after the binder projections are removed from the cavities of the production tool. The post-cure step can be omitted. The degree of cure is preferably sufficient such that the resulting binder projections will retain their shape upon removal from the production tool.

The composition is preferably capable of being cured by radiation energy and/or thermal energy. Sources of radiation energy include, for example, electron beam energy, ultraviolet light, visible light, and laser light.

Electron beam radiation, which is also known as ionizing radiation, can preferably be used at an energy level of about 0.1 Mrad to about 20 Mrad and more preferably at an energy level of about 1 Mrad to about 10 Mrad. Ultraviolet radiation preferably refers to non-particulate radiation having a wavelength of about 200 nanometers to about 400 nanometers and more preferably about 250 nanometers to about 400 nanometers. The dosage of radiation preferably is about 50 $mJ/cm^2$ to about 1000 $mJ/cm^2$, more preferably about 100 $mJ/cm^2$ to about 400 $mJ/cm^2$. Examples of lamp sources that are suitable for providing this amount of dosage preferably provide about 100 Watts/2.54 cm to about 600 Watts/2.54 cm, more preferably about 300 Watts/2.54 cm to about 600 Watts/2.54 cm. Visible radiation preferably refers to non-particulate radiation having a wavelength of about 400 nanometers to about 800 nanometers, more preferably about 400 nanometers to about 550 nanometers. The amount of radiation energy needed to sufficiently cure the composition depends upon a number of factors including, for example, the size of the projections being made, the chemical identity of the composition, and the photoinitiator and radiation source chosen. Conditions for thermal cure preferably are about 50° C. to about 200° C. and for a time of about fractions of minutes to about thousands of minutes. The actual amount of heat required is dependent on the chemistry of the binder precursor.

If ultraviolet or visible light is utilized, a photoinitiator is frequently included in the mixture. Upon being exposed to ultraviolet or visible light, the photoinitiator generates a free radical source or a cationic source. This free radical source or cationic source then initiates the polymerization of the binder precursor. In free radical processes, a photoinitiator is optional when a source of electron beam energy is utilized.

After being at least partially cured, the resulting binder projections will generally not strongly adhere to the surface of the production tool. In either case, at this point, the binder projections are removed from the production tool.

In a variation, the production tool can be a drum or a belt that rotates about an axis. When the production tool rotates about an axis, the process can be conducted continuously. When the production tool is stationary, the process is conducted batch-wise. A continuous process is usually more efficient and economical than the batch-wise processes of the prior art.

In some instances, it may be advantageous to flex the abrasive article prior to use, depending upon the particular pattern of projections provided and the abrading application for which the abrasive article is designed.

The abrasive article can also be made, for example, according to the following second non-limiting method. A composition provided by combining at least an epoxy-functional material; at least one of a cyclic anhydride or a diacid derived therefrom; and optionally a plurality of abrasive grits is introduced to the front side of a backing which also has a back side. The composition wets the front side of the backing to form an intermediate article. The intermediate article is introduced to an outer surface of a production tool having a plurality of cavities in its outer surface to cause at least partial filling of the cavitites. The composition is preferably at least partially cured before the intermediate article departs from the outer surface of the production tool to form the abrasive article. The abrasive article is subsequently removed from the production tool. The aforementioned actions are preferably conducted in a continuous manner, thereby providing an efficient method for preparing an abrasive article.

Figure 4:
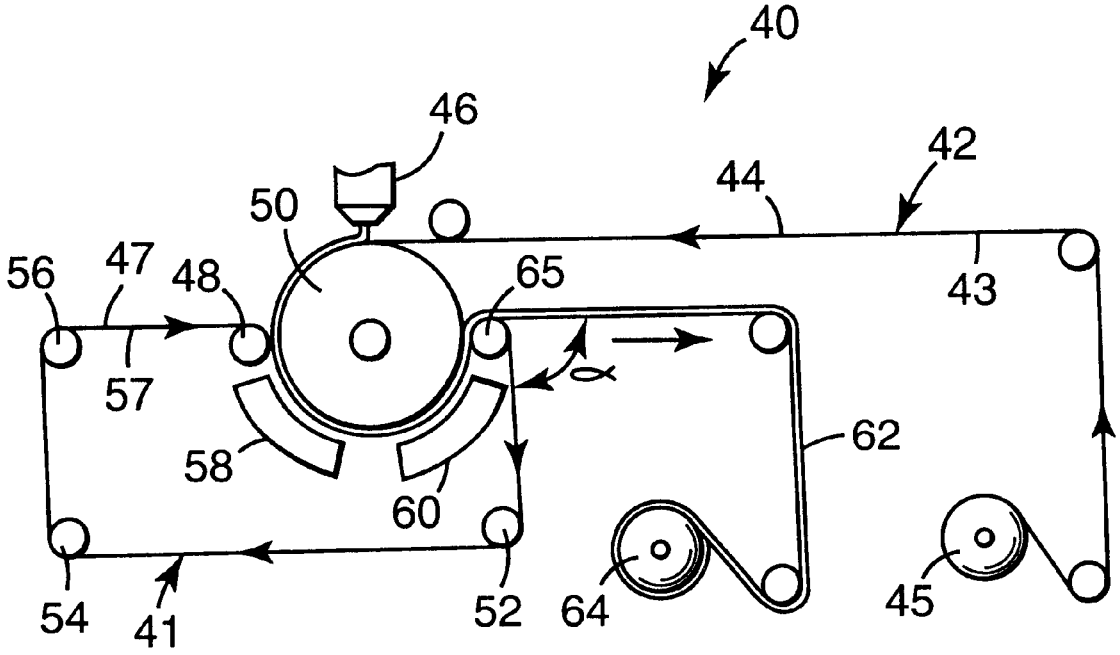
FIG. 4 is a schematic view of an apparatus for making an embodiment of an abrasive article according to the present invention.

The second method is nearly identical to the first method, except that in the second method the composition is initially applied to the backing rather than to the production tool. For example, FIG. 4 illustrates an apparatus 40 for an alternative method of preparing an abrasive article. In this apparatus, a composition is coated onto the backing rather than onto the production tool. In this apparatus, the production tool 41 is an endless belt having a front surface and a back surface. A backing 42 having a back surface 43 and a front surface 44 leaves an unwind station 45. The front surface 44 of the backing is coated with a composition provided by combining at least an epoxy-functional material; at least one of a cyclic anhydride or a diacid derived therefrom; and optionally a plurality of abrasive grits at a coating station 46. The composition is forced against the contacting surface 47 of the production tool 41 by means of a contact nip roll 48, which also forces the production tool/composition/backing construction against a support drum 50, such that the composition wets the contacting surface 47 of the production tool 41. The production tool 41 is driven over three rotating mandrels 52, 54, and 56. Radiation energy is then transmitted through the back surface 57 of production tool 41 and into the composition to at least partially cure the binder precursor. There may be one source of radiation energy 58. There may also be a second source of radiation energy 60. These energy sources may be of the same type or of different types. After the binder precursor is at least partially cured, the shaped, handleable structure 62 is separated from the production tool 41 and wound upon a mandrel 64. Separation of the production tool 41 from the shaped, handleable structure 62 occurs at roller 65. The angle α between the shaped, handleable structure 62 and the production tool 41 immediately after passing over roller 65 is preferably steep, e.g., in excess of 30°, in order to bring about clean separation of the shaped, handleable structure 62 from the production tool 41. If the binder precursor has not been fully cured, it can then be fully cured by exposure to an additional energy source, (e.g., a source of thermal energy or an additional source of radiation energy) to form the coated abrasive article. Alternatively, full cure may eventually result without the use of an additional energy source to form the coated abrasive article.

For either of the above two methods, after the composition is introduced to the production tool, it is advantageous if the composition does not exhibit appreciable flow prior to curing. The aforementioned two embodiments of the method of the invention are considered illustrative and not meant to be limiting. The methods of making structured abrasive articles disclosed, for example, in U.S. Pat. No. 5,152,917 (Pieper et al.); U.S. Pat. No. 5,681,217 (Hoopman et al.); and U.S. Pat. No. 5,855,652 (Stoetzel et al.) can be modified by substituting a composition provided by combining at least an epoxy-functional material and at least one of a cyclic anhydride or a diacid derived therefrom for the binder precursors disclosed in the aforementioned patents.

Although the composition is preferably at least partially cured, it is also within the scope of the present invention to cure the composition after removal from the production tool. For example, the composition may be treated as described in U.S. Pat. No. 5,833,724 (Wei et al.) and U.S. Pat. No. 5,863,306 (Wei et al.) to increase the viscosity of the composition and render it plastic but non-flowing. Such an exemplary procedure is described as follows.

Prior to contacting the production tool, the viscosity of the composition may be modified to limit the flow that would tend to occur at viscosities at which the composition is conventionally deposited. However, it is not necessary that the viscosity of the whole of the composition be increased. It is preferably sufficient that the outer exposed portion quickly attain a higher viscosity, which can then act as a skin to retain the shape of the production tool, even when the inner portion retains a relatively lower viscosity for a longer period.

Viscosity modification of at least the surface layers can be achieved, for example, by incorporating a volatile solvent into the composition. The solvent can be rapidly lost when the composition is deposited on the backing material. Solvent removal may be assisted by an increase in ambient temperature or by a localized blast of hot gas.

Temperature can also affect the viscosity. However, increased temperature may also cause accelerated curing in the case of thermally curable systems. Another option may be to decrease the temperature of the structure such that viscosity is increased. The temperature could be decreased, for example, by passing a substrate having the composition thereon under a chilled roll and/or under a cold gas flow.

In addition to adjusting viscosity by changing temperature or removing a liquid, it may also be possible to change the viscosity by increasing the solids loading. In general, it is sufficient that the surface layer achieve a viscosity sufficient to hold a subsequently imparted shape. Thus, applying a finely divided powder on the surface of the structure may act to form a localized skin of increased viscosity on the structure, causing it to retain an imposed shape until cure renders the shape permanent.

EXAMPLES

Advantages and embodiments according to the present invention are further illustrated by the following examples, but the particular materials and amounts thereof recited in these examples, as well as other conditions and details, should not be construed to unduly limit this invention. All parts and percentages are by weight unless otherwise indicated.

90° Peel Adhesion Test

The abrasive article to be tested was converted into a sample about 8 centimeters wide by 25 centimeters long. One-half the length of a wooden board (17.8 centimeters by 7.6 centimeters by 0.6 centimeter thick) was coated with an adhesive obtained under the trade designation 3M JET MELT ADHESIVE #3779 using a glue applicator obtained under the trade designation POLYGUN II, both obtained from the 3M Company, St. Paul, Minn. Then, the side of the sample bearing the abrasive material was attached to the side of the board bearing the adhesive coating in such a manner that the 10 centimeters of the abrasive sample not bearing the adhesive overhung from the board. Pressure was applied such that the board and the sample were intimately bonded, and sufficient time was allowed for the adhesive to cool and harden.

Next, the sample to be tested was cut along a straight line such that the width of the overhanging abrasive test specimen was reduced to 5.1 centimeters. The resulting abrasive sample/board composite was mounted horizontally in the upper jaw of a tensile testing machine obtained under the trade designation SINTECH 6W from MTS Systems Corp., Eden Prairie, Minn., and approximately 1 centimeter of the overhanging portion of the abrasive sample was mounted into the lower jaw of the machine such that the distance between jaws was 10.2 centimeters. The machine separated the jaws at a rate of 0.5 cm/sec, with the abrasive sample being pulled at an angle of 90° away from the wooden board so that a portion of the sample separated from the board. The machine charted the force per centimeter of specimen width required to separate the cloth from the treatment coating. Generally, the higher the required force, the better adhesion of the abrasive coating to the cloth backing.

Rocker Drum (RD) Test

A rocker drum test was used to evaluate the ability of an abrasive article to abrade a 0.48 cm square mild steel workpiece. More specifically, the abrasive articles of Comparative Example A and Examples 1–5 were converted into 10.2 cm wide by 15.2 cm long sheets that were mounted to the cylindrical drum of a rocker drum testing machine (machine type) which oscillated (rocked) back and forth at the rate of about 60 strokes per minute (one complete back and forth cycle equals one stroke). During oscillation, the abrasive article was in contact with the mild steel workpiece. The oscillatory motion against a workpiece wore an approximately 0.48 cm wide by 14.0 cm long path on the abrasive article. The force applied to the workpiece was either 26.5 N or 17.6 N (as noted). The weight loss of the workpiece was measured and recorded as "Carbon Steel cut" in Table 3. The results are reported in Table 3 as an average of two test samples. The abrasive article sample thickness was monitored using a micrometer and its decrease in thickness reported as "Wear."

The present invention is illustrated by the following examples. It is to be understood that the particular examples, materials, amounts, and procedures are to be interpreted broadly in accordance with the scope and spirit of the invention as set forth herein.

Procedure for Making Abrasive Articles of Comparative Example A and Examples 1–5

Comparative Example A and Examples 1–5 demonstrate the effects of varying the ratio of polyfunctional (meth) acrylate monomer to that of the epoxy-functional material/cyclic anhydride combination.

Comparative Example A

A premix was prepared by combining the following ingredients and mixing with a high shear mixer:

1892 g of trimethylolpropane triacrylate (TMPTA) obtained under the trade designation SR 351, Sartomer Company, West Chester, Pa.; 1076 g of wollastonite calcium metasilicate, obtained from NYCO Minerals Inc., Willsboro, N.Y.; 18.9 g of photoinitiator obtained under the trade designation IRGACURE 819, from Ciba Specialty Chemical Corporation, Tarrytown, N.Y.; 57.5 g of silicon dioxide, obtained under the trade designation AEROSIL OX-50 from Degussa-Huls Ltd. (Ridgefield Park, N.J.); 5 g of wetting agent (including 97 weight % phosphated polyester, and 3 weight percent phosphoric acid) obtained under the trade designation DISPERBYK 111, from BYK-Chemie, Wesel, Germany; and 10 g of epoxy silane adhesion promoter obtained under the trade designation Silquest A-187 from OSI Specialties, Inc., Friendly, W.Va.

The total weight of the premix was 3059.4 g. Brown aluminum oxide abrasive grit (2400 g) obtained under the trade designation DURALUM GW from Washington Mills Electrominerals, Niagra Falls, N.Y., were added to and mixed into the premix with a high sheer mixer in order to form an abrasive slurry.

The abrasive slurry was coated onto a conventional latex-phenolic treated polyester cloth. The slurry was coated onto the front surface of the cloth (i.e., the surface opposite the backsize) with a knife coater using a 305 micrometer (12 mil) gap at a speed of about 15.24 meters/minute for all Examples except for Example 7, which was coated at a speed of about 5.79 meters/minute, so that the abrasive slurry wetted the front surface of the cloth. Next, the cavities of a polypropylene production tool roller was nipped over the slurry coated backing so that the abrasive slurry was embossed with the pattern of the production tool.

The production tool and the process to make the tool to make Comparative Example A and Examples 1–5 were similar to those described in Example 1 of U.S. Pat. No. 5,946,991 (Hoopman). Such production tools exhibit a pseudo-random array of pyramidal cavities. All cavities were about 20 mil (508 $\mu$m) in height. The width of the bases of the pyramidal cavities were 39.9, 33.7, 28.4 or 23.7 mils (1.0, 0.86, 0.72, or 0.60 mm). A representation of this pseudo-random array of pyramidal cavities is shown in FIG. 1.

The specific abrasive projections formed by the production tool used in Comparative Example A and Examples 1–5 were 507 micrometer (20 mil) high, four sided pyramids. The pattern of pyramids formed by the production tool was such that no two adjacent pyramids had the same shape, i.e., the angles between adjacent pyramids were random as were the lengths of the sides of the pyramids. The minimum and maximum angles between two adjacent pyramids were 60 and 90 degrees, respectively.

Ultraviolet/visible radiation, at a dosage of about 236 Watts/cm (600 Watts/inch) produced by 2 D bulbs, obtained from Fusion UV Systems (Gaithersburg, Md.), was transmitted through the production tool and into the abrasive slurry. The ultraviolet/visible radiation initiated the curing of the composition and resulted in the abrasive slurry forming abrasive projections which were adhered or fixed to the cloth backing.

Finally, the abrasive article was separated from the production tool.

Example 1

The procedure of Comparative Example A was followed except that with respect to the premix, the amount of trimethylolpropane triacrylate (SR 351) was 1419 g, the amount of photoinitiator (IRGACURE 819) was 14.2 g, and that the following components were also included when making the premix: 328 g of Bisphenol A diglycidyl ether epoxy-functional material obtained under the trade designation EPON 825 from Resolution Performance Products, Houston, Tex.; 140 g of hexahydrophthalic anhydride (HHPA) obtained from Buffalo Color Corporation, Buffalo, N.Y.; and 10 g of triaryl sulfonium hexaflouroantimonate (50% in propylene carbonate) obtained under the trade designation SAR-CAT CD1010 from Sartomer Company, West Chester, Pa. The total weight of the premix was 3059.7 g. The amount of polyfunctional (meth)acrylate present based on the amount in Comparative Example A was 75 weight percent.

Example 2

The procedure of Example 1 was followed except that with respect to the premix, the amount of trimethylolpropane triacrylate (SR 351) was 1136 g, the amount of photoinitiator (IRGACURE 819) was 11.4 g, the amount of Bisphenol A diglycidyl ether epoxy-functional material was 524 g, the amount of HHPA was 225 g, and the amount of triaryl sulfonium hexafluoroantimonate (50% in propylene carbonate) was 15 g. The total weight of the premix was 3059.9 g. The amount of polyfunctional (meth)acrylate used based on the amount used in Comparative Example A was 60 weight percent.

Example 3

The procedure of Example 1 was followed except that with respect to the premix, the amount of trimethylolpropane triacrylate (SR 351) was 942 g, the amount of photoinitiator (IRGACURE 819) was 9.4 g, the amount of Bisphenol A diglycidyl ether epoxy-functional material was 659 g, the amount of HHPA was 282 g, and the amount of triaryl sulfonium hexafluoroantimonate (50% in propylene carbonate) was 19 g. The total weight of the premix was 3059.9 g. The amount of polyfunctional (meth)acrylate used based on the amount used in Comparative Example A was 50 weight percent.

Example 4

The procedure of Example 1 was followed except that with respect to the premix, the amount of trimethylolpropane triacrylate (SR 351) was 756 g, the amount of photoinitiator (IRGACURE 819) was 7.6 g, the amount of Bisphenol A diglycidyl ether epoxy-functional material was 787 g, the amount of HHPA was 337 g, and the amount of triaryl sulfonium hexafluoroantimonate (50% in propylene carbonate) was 23 g. The total weight of the premix was 3059.1 g. The amount of polyfunctional (meth)acrylate used based on the amount used in Comparative Example A was 40 weight percent.

Example 5

The procedure of Example 1 was followed except that with respect to the premix, the amount of trimethylolpropane triacrylate (SR 351) was 473 g, the amount of photoinitiator (IRGACURE 819) was 4.7 g, the amount of Bisphenol A diglycidyl ether epoxy-functional material was 983 g, the amount of HHPA was 421 g, and the amount of triaryl sulfonium hexafluoroantimonate (50% in propylene carbonate) was 29 g. The total weight of the premix was 3059.2 g. The amount of polyfunctional (meth)acrylate used based on the amount used in Comparative Example A was 25 weight percent.

Comparative Example B and Examples 6–7

Premixes were prepared by combining the ingredients listed in Table 1 and mixing with a high shear mixer:

TABLE 1

Premix Ingredients for Examples 7–9

| Example | Comparative Example B | Example 6 | Example 7 |
|---|---|---|---|
| % (meth)acrylate | 100% | 50% | 0% |
| TMPTA ("SR 351") acrylate monomer, trimethylolpropane triacrylate Sartomer Company, West Chester, PA | 1892 | 942 | — |
| ERL-4221 (80%) epoxy-functional material, Union Carbide Corp., Danbury, CT | — | 527 | 1049 |
| EPON 825 epoxy-functional material (bisphenol A diglycidyl ether), Resolution Performance Products, Houston, TX | — | 132 | 262 |
| HHPA anhydride monomer, hexahydrophthalic anhydride, Buffalo Color Corporation, Buffalo, NY | — | 282 | 562 |
| wollastonite calcium metasilicate, NYCO Minerals Inc., Willsboro, NY | 1076 | 1076 | 1076 |
| IRGACURE 819, photoinitiator, Ciba Specialty Chemical Corporation, Tarrytown, NY | 18.9 | 9.4 | — |
| SAR-CAT CD1010, triaryl sulfonium hexafluoroantimonate 50% in propylene carbonate, Sartomer Company, West Chester, PA | — | 19 | 38 |
| Aerosil OX-50 silicon dioxide, Degussa-Huls Ltd., Cheshire, UK | 57.5 | 57.5 | 57.5 |
| Silquest A-187 (epoxy silane) adhesion promoter, OSI Specialties Inc., Friendly, WV | 10 | 10 | 10 |
| Premix Total | 3059.1 | 3059.2 | 3059.5 |
| Mineral | 2400 | 2400 | 2400 |

Comparative Examples A–B and Examples 1–7 demonstrate the effects of varying the ratio of (meth)acrylate monomer to that of the epoxy/cyclic anhydride combination. Abrasive articles were made according to Procedure For Making An Abrasive Article, above. Comparative Examples A–B and Examples 1–7 were of the compositions shown in Table 1. Abrasive articles of Comparative Examples A–B Examples 1–7 were tested for adhesion according to the 90° Peel Test, and Comparative Example A and Examples 1–5 were tested for grinding efficiency according to the Rocker Drum Test. The results, shown in Table 2, indicate that superior adhesion, greater cut, and prolonged life occurs when the abrasive composites include at least 25% by weight total of epoxy-functional material and cyclic anhydride.

TABLE 2

90° Peel and Rocker Drum Test Results

| Example | 90° Peel Adhesion, lb/in (N/cm) | Rocker Drum carbon steel cut, g | Rocker Drum wear, mil (mm) |
|---|---|---|---|
| Comparative Example A | 14.7 (25.8) | 1.145 | 12.8 (0.33) |
| 1 | 17.7 (31.0) | 1.685 | 11.0 (0.28) |
| 2 | 20.0 (35.0) | 1.765 | 17.5 (0.44) |
| 3 | 19.5 (34.2) | 1.245 | 12.7 (0.32) |
| 4 | 4.6 (8.1) | 1.040 | 8.0 (0.20) |
| 5 | 1.8 (3.2) | 1.180 | 8.9 (0.23) |
| Comparative Example B | 7.25 (12.7) | 0.905 | Not Determined |
| 6 | 16.25 (28.5) | 1.675 | Not Determined |
| 7 | 17.3 (30.3) | 1.035 | Not Determined |

The complete disclosure of all patents, patent applications, and publications, and electronically available material cited herein are incorporated by reference. The foregoing detailed description and examples have been given for clarity of understanding only. No unnecessary limitations are to be understood therefrom. The invention is not limited to the exact details shown and described, for variations obvious to one skilled in the art will be included within the invention defined by the claims.

What is claimed is:

1. An abrasive article comprising:

a backing having a major surface;

a plurality of projections attached to the major surface, wherein the projections are formed by use of a production tool; and a binder comprising a reaction product of components comprising (a) an epoxy-functional material, and (b) at least one of a non-polymeric cyclic anhydride or a diacid derived therefrom.

2. The article of claim 1 wherein the components further comprise (c) a curing agent.

3. The article of claim 1 wherein the components further comprise (c) a polyfunctional (meth)acrylate.

4. The article of claim 3 wherein the polyfunctional (meth)acrylate is a monomer, an oligomer, or a polymer.

5. The article of claim 3 wherein the components further comprise (d) a free radical initiator.

6. The article of claim 1 wherein the binder further comprises a plurality of abrasive grits.

7. The article of claim 1 wherein the projections are composite projections comprising abrasive grits.

8. The article of claim 1 wherein the binder is present in the backing.

9. The article of claim 1 wherein the binder is present on the backing.

10. The article of claim 1 wherein the projections comprise the binder.

11. An abrasive article comprising:

a backing having a major surface;

a plurality of projections attached to the major surface, wherein the projections are formed by use of a production tool; and a binder preparable by combining components comprising at least (a) an epoxy-functional material, and (b) at least one of a non-polymeric cyclic anhydride or a diacid derived therefrom.

12. The article of claim 11 wherein the components further comprise (c) a curing agent.

13. The article of claim 11 wherein the components further comprise (c) a polyfunctional (meth)acrylate.

14. The article of claim 13 wherein the polyfunctional (meth)acrylate is a monomer, an oligomer, or a polymer.

15. The article of claim 13 wherein the components further comprise (d) a free radical initiator.

16. The article of claim 11 wherein the binder further comprises a plurality of abrasive grits.

17. The article of claim 11 wherein the projections are composite projections comprising abrasive grits.

18. The article of claim 11 wherein the binder is present in the backing.

19. The article of claim 11 wherein the binder is present on the backing.

20. The article of claim 11 wherein the projections comprise the binder.

21. A method of making an abrasive article comprising:

providing a production tool having a three-dimensional body with one or more cavities, at least a portion of the one or more cavities having therein a composition preparable by combining components comprising at least (a) an epoxy-functional material, and (b) at least one of a non-polymeric cyclic anhydride or a diacid derived therefrom, and wherein the production tool has a backing that has a major surface adjacent the one or more cavities; and at least partially curing at least a portion of the composition to form an abrasive article.

22. The method of claim 21 wherein the components further comprise (c) a polyfunctional (meth)acrylate.

23. The method of claim 21 wherein at least partially curing at least a portion of the composition comprises at least partially curing at least a portion of the composition in at least a portion of the one or more cavities of the production tool.

24. The method of claim 21 further comprising removing the backing from at least a portion of the one or more cavities to provide an abrasive article having projections attached to the major surface of the backing.

25. The method of claim 21 wherein providing the production tool further comprises providing an intermediate layer between the major surface of the backing and at least a portion of the one or more cavities.

26. The method of claim 21 wherein providing the production tool comprises:

providing a production tool having a three-dimensional body with one or more cavities, at least a portion of the one or more cavities having therein a composition preparable by combining at least (a) an epoxy-functional material, and (b) at least one of a non-polymeric cyclic anhydride or a diacid derived therefrom; and applying a major surface of a backing to at least a portion of the one or more cavities.

27. The method of claim 26 further comprising allowing the composition to wet the major surface of the backing.

28. The method of claim 26 wherein providing the production tool comprises:

providing a production tool having a three-dimensional body with one or more cavities; and introducing into at least a portion of the one or more cavities a composition preparable by combining at least (a) an epoxy-functional material, and (b) at least one of a non-polymeric cyclic anhydride or a diacid derived therefrom.

29. The method of claim 21 wherein providing the production tool comprises:

providing a production tool having a three-dimensional body with one or more cavities; and applying to at least a portion of the one or more cavities a major surface of a backing having thereon a composition preparable by combining at least (a) an epoxy-functional material, and (b) at least one of a non-polymeric cyclic anhydride or a diacid derived therefrom.

30. The method of claim 29 wherein the backing is produced by:

providing a backing that has a major surface; and applying to the major surface of the backing a composition preparable by combining components comprising at least (a) an epoxy-functional material, and (b) at least one of a non-polymeric cyclic anhydride or a diacid derived therefrom.

31. The method of claim 21 wherein the components further comprise (c) a curing agent.

32. The method of claim 22 wherein the components further comprise (d) a free radical initiator.

33. The method of claim 21 wherein the composition further comprises a plurality of abrasive grits.

34. The method of claim 21 wherein at least partially curing at least a portion of the composition comprises irradiating at least a portion of the composition.

35. The method of claim 34 further comprising thermally curing at least a portion of the abrasive article.

* * * * *